US005118942A

United States Patent [19]

Hamade

[11] Patent Number: 5,118,942

[45] Date of Patent: * Jun. 2, 1992

[54] ELECTROSTATIC CHARGING APPARATUS AND METHOD

[76] Inventor: Thomas A. Hamade, Box 2963, Farmington Hills, Mich. 48333

[ * ] Notice: The portion of the term of this patent subsequent to Apr. 30, 2008 has been disclaimed.

[21] Appl. No.: 652,058

[22] Filed: Feb. 7, 1991

Related U.S. Application Data

[63] Continuation-in-part of Ser. No. 475,366, Feb. 5, 1990, Pat. No. 5,012,094.

[51] Int. Cl.[5] ..... H01T 19/00

[52] U.S. Cl. ..... 250/324; 250/326; 361/225; 361/226; 361/227; 361/228; 361/229; 361/230; 355/221; 426/240; 422/907

[58] Field of Search ..... 250/324, 325, 326; 361/225, 226, 227, 228, 229, 230; 355/221; 55/150; 426/240; 422/907

[56] References Cited

U.S. PATENT DOCUMENTS

| | | | |
|---|---|---|---|
| 2,890,633 | 6/1959 | Huebner | 250/326 |
| 3,413,545 | 11/1968 | Whitby | 361/226 |
| 3,566,110 | 2/1971 | Gillespie | 250/326 |
| 3,754,117 | 8/1973 | Walter | 250/325 |
| 3,862,420 | 1/1975 | Banks et al. | 250/324 |
| 4,153,836 | 5/1979 | Simm | 250/325 |
| 4,275,301 | 6/1981 | Rueggeberg | 250/326 |
| 4,656,356 | 4/1987 | Yoda et al. | 250/324 |
| 4,745,282 | 5/1988 | Bergen | 250/326 |
| 4,853,005 | 8/1989 | Jaisinghani et al. | 55/132 |
| 5,012,094 | 4/1991 | Hamade | 250/324 |

FOREIGN PATENT DOCUMENTS

| | | | |
|---|---|---|---|
| 45-28430 | 1/1970 | Japan | 55/150 |
| 455731 | 1/1975 | U.S.S.R. | 426/240 |

OTHER PUBLICATIONS

Science News vol. 30 No. 13, Mar. 30, 1991 p. 207.

Effect of Relative Humidity on Electrically Stimulated Filter Performance, Jaisinghani et al, JAPCA, 37, 7 (pp. 823-828) Jul., 1987.

*Primary Examiner*—Jack I. Berman

*Attorney, Agent, or Firm*—Peter D. Keefe

[57] ABSTRACT

An apparatus and method for providing a charged fluid and for creating an electret from a receptor, such as roll mill polymer film, whereby the electret will have the highest possible static electrical charge within the physical limits of the receptor. The apparatus according to the present invention includes, inter alia, a housing, a plurality of equidistantly spaced electrodes, each electrode having optimum geometry, location and electrification voltage so as to provide a maximum, uniform electric field therebetween, the electrodes collectively forming a charger grid within the housing, and a source of flowing gaseous fluid entering into the housing, the flowing gaseous fluid ionizing at the charger grid, resulting in an optimized corona within the housing. The method according to the present invention induces an optimal corona, defined as a maximum possible electric field having a strength that is near the spark over voltage, in a flowing gaseous fluid by passing the gaseous fluid past the charger grid. The resulting ionization of the flowing gaseous fluid is then utilized to transport electrical charge to a device such as an electrostatic filter and aerosol mixer or the surface of a receptor. The apparatus and method are suitable for the antibacterialogical and antiviral treatment of biologic substances, such as animal organisms, plant organisms, blood and tissue, and also other substances, such as waste water.

35 Claims, 9 Drawing Sheets

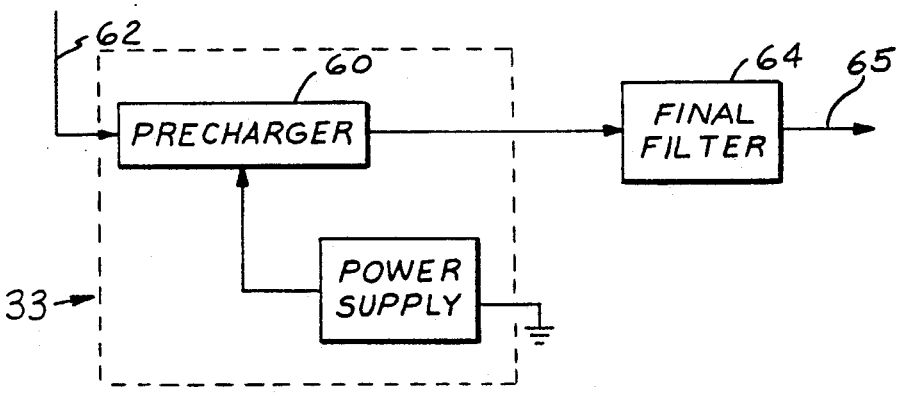
FIG.5
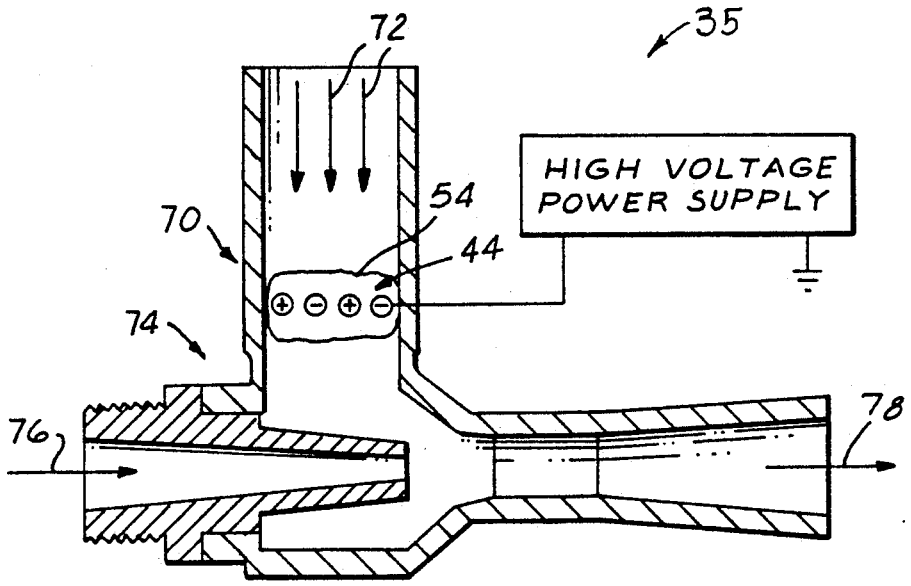
FIG.6
FIG.7
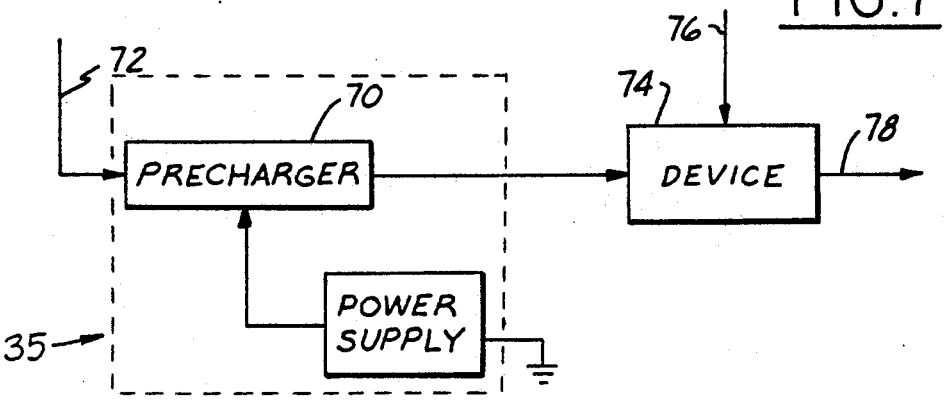

ELECTROSTATIC CHARGING APPARATUS AND METHOD

CROSS-REFERENCE TO RELATED APPLICATIONS

The present application is a continuation-in-part of my application, Ser. No. 07/475,366, filed on Feb. 5, 1990, now U.S. Pat. No. 5,012,094.

BACKGROUND OF THE INVENTION

1. Field of the Invention

The present invention relates to electrostatic charging devices, particularly those utilizing corona in a gaseous medium to induce charge on and in a receptor material. The present invention further relates, more particularly, to electrostatic charging devices which utilize a flowing fluid medium to convectively transport charge from an ionizing corona to a receptor surface. Still more particularly, the present invention relates to an electrostatic charging apparatus for optimally charging and treating biological substances.

2. Description of the Prior Art

A. Electret Theory

It has been known for a long time that polymer materials may be static electrically charged, or for brevity, charged. When charged, such polymers are known as "electrets". Electrets have significant commercial value. For instance, the electric field produced by the electret can be used to attract other materials, such as dust particles. This attractive or "inductive" property exhibited by electrets enables filters to be constructed having the ability to capture sub-micron particles when the filter media contains electret materials. Other examples of the value of electrets include their energy retention capability which may be utilized to provide a battery or used effectively in electrophotography.

As can be understood with reference to FIG. 1, an electret 10 may exhibit static electrical charge by any of several different mechanisms, most notably: selectively aligned molecular dipoles 12, injected space charges 14 and deposited surface charges 16. The charging process, itself, is accomplished by either a transfer of electrons to or from the material, thereby resulting in a net positive or negative charge, or an interior re-alignment (that is, polarization) of the protons and electrons on the molecular level, thereby resulting in a net charge as measured between different locations on the surface of the material (the total surface net charge caused thereby remaining zero), or a combination of each of the foregoing processes.

FIG. 2 exemplifies the standard commercial technique for production of electrets from roll mill polymer film stock. A high voltage (kilovoltage) power supply 18 is connected to an electrode 20. The electrode must have a sharp point, edge, corner or other similar feature because a location of small radius of curvature is known to produce a highest possible electric field in the shortest possible space. As a result of D.C. electrification of the electrode, the surrounding gaseous medium 22 (usually being composed simply of air) in the vicinity of the electrode 20 becomes ionized. The region defined by this ionized gaseous medium is known as corona 24. The corona extends downwardly from the electrode 20 toward a grounded base plate 26. For the most part, the gaseous medium 22 and the corona 24 are stable and not in motion. The exact size and shape of the corona depends upon many factors including: the voltage difference between the electrode and the grounded plate, the distance of their mutual separation, and their relative geometries, as well as the dielectric properties of the gaseous medium (as may be affected, too, by temperature and humidity).

In operation, the roll mill polymer 28 is fed through the corona 24, with the expectation that the corona will induce charge in the polymer by induction (resulting in the production of interior dipoles) and by conduction (resulting in charge being deposited on the surface). However, as can be seen from the middle depiction in FIG. 2, actually, when the roll mill polymer 28 enters the region between the electrode 20 and the grounded base plate 26, the nature of the dielectric space therebetween has been radically changed, resulting in the disappearance of the corona. Consequently, charging to the roll mill polymer is actually produced by induction between the electrode and the grounded base plate, without contribution from the ionization of the gaseous medium above roll mill polymer. The bottom-line is that the ultimate charge production in the roll mill polymer is compromised by the disappearance of the corona, so that the resulting electret 30 so produced, as shown in the bottom depiction in FIG. 2, is charged considerably below that level which is theoretically possible for the particular electret material.

Other methods of producing electrets are known and utilized with varying degrees of success.

Thermal charging methods heat a polymer sheet, causing reduction in the internal viscous forces binding the molecules and/or atoms which are arranged in a matrix or array. An external electric field is applied, thereby causing internal dipole production as molecules and/or atoms align with respect to the external electric field. The polymer sheet is then cooled and the external electric field is thereupon removed. Removal of the external electric field results in a "thermoelectret", as the aligned molecules and/or atoms are delayed for an extended time period from returning to their originally unaligned orientations due to viscous forces. This method is suitable only for dipolar polymers, and the considerable charging time required is a significant drawback.

Photoelectric charging methods utilize those polymers which exhibit photoconductivity. Light of a discrete quanta is directed at the polymer surface, imparting energy to the surface electrons. Under a process known as the photoelectric effect, electrons are ejected from the polymer. This method is generally not usable commercially, but has found some use in electrophotocopy technology for reversing electret charge.

Radio charging methods utilize a radio wave as an excitation medium to cause electrons to occupy temporarily higher energy states in otherwise forbidden energy bands. This movement of electronic charge creates a space charge within the polymer. This method is quite limited in applicability and the radio energy necessary is considerable.

Low-energy electron beam methods utilize an ion beam to irradiate the polymer surface. This method is plagued by difficulty in assuring uniformity of energy dispersion across the polymer surface. However, the mono-energetic electrons of these beams can be precisely controlled so as to achieve charge deposition to a desired predetermined depth. Accordingly, this method has gained widespread acceptance for producing electret diaphragms in electro-acoustic transducers.

Finally, contact (or triboelectric) charging methods utilize two dissimilar materials that are physically rubbed together. As a polymer and another, dissimilar, material are rubbed together, friction is the driving force that produces a net charge transfer across the interface between the materials. However, because of lack of reproducibility in the ultimate charge attained each time this process is performed, this type of charging method has found little acceptance in industry.

B. Examples of Prior Art Corona Chargers

Now, in the prior art there are various electrostatic charging devices that have been constructed which utilize corona charging. With due regard to the hereinabove recounted difficulties encountered with corona charging, the following patents offer various solutions.

U.S. Pat. No. 3,566,110 to Gillespie et al, dated Feb. 23, 1971 discloses an electrostatic charging apparatus which is structured for use in electrostatic printing. The device utilizes a conventional corona charger upstream of a convective corona charger. The convective corona charger is composed of a conduit into which is located a charger device composed of: 1) a series of charger electrodes having a first polarity and located remote from the receptor surface and 2) a screen-like charger electrode having a second polarity and located adjacent the series of charger electrodes. A blower directs air past the charger device, the air becomes ionized, then convectively makes contact with the receptor surface.

U.S. Pat. No. 3,754,117 to Walter, dated Aug. 21, 1973 discloses a device for charging a layer of material utilizing a corona charger. An adjacent nozzle supplies a gas utilized to provide improved surface treatment resulting from the corona effect.

U.S. Pat. No. 4,153,836 to Simm, dated May 8, 1979 discloses a device for recording half-tone images in a photocopier device. A container is filled with nitrogen that is introduced through a conduit. Within the container is a corona discharge electrode. The nitrogen exits at a gap in a slotted diaphragm. The charge transfer characteristic is altered by varying voltage applied to two separated plates located at either side of the diaphragm.

U.S. Pat. No. 4,275,301 to Rueggeberg, dated Jun. 23, 1981 discloses a device for deglossing a vinyl floor tile by utilization of corona discharge characteristic of a selected gas. The selected gas enters an upper plenum, travels to a lower plenum and exits the device on either side of a corona discharge electrode. Corona discharge exists in the gap formed between the corona discharge electrode and a ground electrode, the vinyl floor tile traversing the space therebetween.

U.S. Pat. No. 4,762,997 to Bergen, dated Aug. 9, 1988 discloses a fluid transport electrostatic charger used in electrostatic printing (photocopying). Air enters a plenum, then passes through a metering slit into a chamber housing a charger electrode. The air becomes ionized, then exits the charger so as to transfer charge to a receptor surface.

U.S. Pat. No. 4,745,282 to Tagawa et al, dated May 17, 1988 discloses a ventilated corona charger used in electrostatic printing. Ventilation is provided because of charge non-uniformity caused by irregularities in the atmosphere in and about the corona. A blower is supplied which directs a controlled stream of fresh air past electrode wires, thereby serving to stabilize the corona discharge characteristics.

U.S. Pat. No. 4,853,005 to Jaisinghani et al. dated Aug. 1, 1989 discloses an electrically stimulated filter, in which a perforated plate serves as one electrode and a series of parallel wires serve as the second electrode. A corona is established therebetween which charges incoming air in advance of encountering an electrostatic filter device.

C. Discussion of the Prior Art

I have exhaustively studied the characteristics of corona discharge, and have found that the greatest difficulty in corona discharge has to do with maintenance of the corona when the receptor is being charged. This is due to variation in the dielectric value between the corona electrode and a grounded base as the receptor passes therebetween. I have determined that the only effective way to eliminate this problem is to engineer a charger in which the corona is not substantially affected by the presence of the receptor. My research has led me to the conclusion that this goal may be accomplished by creating a corona in a flowing gaseous fluid, the ionized fluid then contacting the receptor, thereby transferring charge at its surface.

Each of the patents cited above contemplate ionized gaseous fluids attendant to a charging process. Indeed, the patents to Simm, Bergen, Gillespie et al, and Tagawa et al contemplate specifically charging a sheet receptor by ionized gas convention between the corona electrode and the receptor. However, my research, as will be elaborated hereinbelow, indicates that these prior art devices do not effectively solve the problems associated with corona chargers used in the production of electrets. Simm, Bergen, Gillespie et al and Tagawa et al reference use of their respective devices in electrostatic copying machines. Electrostatic copiers impart only that minimum charge to the receptor which is necessary to effect printing. For comparison, this same charge exposure applied to a polymer receptor will only produce an inferior quality electret. What is needed in the art is an apparatus and method to achieve a maximum possible charge on the electret, a charge orders of magnitude greater than that used in electrostatic copying.

In order to maximize electret charge, an optimal charger is needed: one where charge is imparted on the receptor by use of ionization of a gaseous fluid convecting through a corona, so that the corona will not be diminished by the presence of the receptor; and where corona is maximized, geometry is optimized, and efficiency is able to be maintained for extended periods of operational time.

Referring once again to the above cited patents, several significant distinctions can be drawn to show that none of these offer a structure that serves as the optimal charger for production of electrets.

Gillespie uses a wire screen as an electrode; this is subject to quick clogging by dust particles. Further, Gillespie locates the electrodes far too remote from the receptor; the geometry is not optimum. Charge delivery is orders of magnitude below that which is required to produce quality electrets.

Walter has no sharp electrode edges; the corona is very weak.

Simm uses only a single needle point to provide an electrode and the needle point is positioned so that the nitrogen may easily by-pass the vicinity of the needle and never experience corona; the geometry is not optimum and corona is very weak.

Rueggeberg uses a very large electrode surface which is subject to quick contamination. Further, the electrode has no sharp edges, so it provides only weak corona.

Tagawa et al uses an electrode system composed of a plate with adjacent wire or wires; the plate is subject to rapid contamination. The geometry is not optimized and the electrode system will produce weak charging.

Bergen uses an electrode system composed of a wire in a cylinder; the cylinder is subject to rapid contamination. The electrode system is remote from the receptor; geometry is not optimized.

Jaisinghani et al uses a perforated metal plate as one electrode which is subject to quick degradation by contamination build-up. Further, air flow is restricted because the perforated plate is oriented transverse to the air flow stream.

Accordingly, what remains in the prior art is to provide an optimally configured charger using a convecting fluid in which the corona is optimized everywhere in the cross-section of flow of the convecting fluid.

These, and additional objects, advantages, features and benefits of the present invention will become apparent from the following specification.

SUMMARY OF THE INVENTION

The present invention is an improved apparatus and method for creating an electret from a receptor, such as roll mill polymer film, whereby the electret will have the highest possible static electrical charge within the physical limits of the receptor. Further according to the present invention, an apparatus and method are provided for charging and treating biological substances.

The apparatus according to the present invention includes, inter alia, a housing, a plurality of equidistantly spaced electrodes, each electrode having optimum geometry, location and electrification voltage so as to provide a maximum, uniform electric field therebetween, the electrodes collectively forming a charger grid within the housing, and a source of flowing gaseous fluid entering into the housing, the flowing gaseous fluid ionizing at the charger grid, resulting in an optimized corona within the housing.

The method according to the present invention induces an optimal corona, defined as a maximum possible electric field having a strength that is near the spark over voltage, in a flowing gaseous fluid by passing the gaseous fluid past the charger grid. The resulting ionization of the flowing gaseous fluid is then utilized to transport electrical charge to a device such as an electrostatic filter, and aerosol mixer or the surface of a receptor.

Accordingly, it is an object of the present invention to provide a corona charger for providing a charged gaseous fluid, in which the corona exists in a moving gaseous fluid, inclusive of aerosols, the corona being optimal across the cross-section of flow of the moving gaseous fluid due to creation of a maximum electric field between adjacent electrodes, each electrode having a predetermined optimum geometry, each adjacent electrode being mutually equally spaced, and each electrode having a preselected electrification polarity, the predetermined optimum geometry of the electrodes being such as to not be susceptible to contamination build-up.

It is an additional object of the present invention to provide an optimal corona charging apparatus and method that will produce an electret from a receptor, such as roll mill polymer film, where optimal charging is accomplished using corona in a convecting gaseous fluid, where the corona is created by a charger grid that is not susceptible to contamination build-up.

It is yet a further object of the present invention to provide an optimal corona charging apparatus and method that will produce an electret from a receptor, where optimal charging is accomplished using corona in a convecting gaseous fluid and where charging is accomplished in part by conduction and induction due to transport of ionized and polarized molecules of the gaseous fluid and in part by induction from the corona and from a charger grid of the corona charging apparatus.

It is yet a further object of the present invention to provide an optimal corona charging apparatus and method that will produce an electret from a receptor, where optimal charging is accomplished using corona in a convecting gaseous fluid and where charging is accomplished in part by conduction and induction due to transport of ionized and polarized molecules of the gaseous fluid and in part by induction from a charger grid of the corona charging apparatus, optimization of the corona charging apparatus being in part dependent upon a preselected charger grid to receptor surface distance.

It is yet a further object of the present invention to provide an optimal corona charging apparatus and method that will produce an electret from a receptor, where optimal charging is accomplished using corona in a convecting gaseous fluid and where charging is accomplished in part by conduction and induction due to transport of ionized and polarized molecules of the gaseous fluid and in part by induction from a charger grid of the corona charging apparatus, optimization of the corona discharge apparatus being in part dependent upon selection of a multicomponent grid electrode member where each electrode has a predetermined optimum geometry, each adjacent electrode is mutually equally spaced and each electrode has a preselected electrification polarity.

It is yet a further object of the present invention to provide an optimal corona charging apparatus and method that will produce an electret from a receptor, where optimal charging is accomplished using corona in a convecting gaseous fluid and where charging is accomplished in part by conduction and induction due to transport of ionized and polarized molecules of the gaseous fluid and in part by induction from a charger grid of the corona charging apparatus, optimization of the corona charging apparatus being in part dependent upon a preselection of a gaseous fluid flowing at a predetermined flow rate past the charger grid and over the surface of the receptor, the respective molecular velocities of the gaseous fluid past the charger grid and over the surface of the receptor being determined by geometry of respectively adjacent flow defining structure.

It is yet a further object of the present invention to provide an optimal corona charging apparatus and method that will produce an electret from a receptor, where optimal charging is accomplished using corona in a convecting gaseous fluid and where charging is accomplished in part by conduction and induction due to transport of ionized and polarized molecules of the gaseous fluid and in part by induction from a charger grid of the corona charging apparatus, optimization of the corona charging apparatus being in part dependent upon the selected charger grid having a predetermined voltage applied to the grid electrodes.

It is still a further object of the present invention to provide an optimal corona charging apparatus and method that will produce an electret from a receptor, where optimal charging is accomplished using corona in at least two separate convecting gaseous fluids and where charging is accomplished in part by conduction and induction due to transport of ionized and polarized molecules of the gaseous fluid and in part by induction from a charger grid of the corona charging apparatus, optimization of the corona charging apparatus being in part dependent upon the selected charger grid having a predetermined voltage applied to the grid electrodes.

It is further an additional object of the present invention to provide an optimal corona charging apparatus and method that will charge biological substances, inclusive of organisms, foodstuffs, and blood, where optimal charging is accomplished using corona in a convecting gaseous fluid and where charging is accomplished in part by conduction and induction due to transport of ionized and polarized molecules of the gaseous fluid and in part by induction from a charger grid of the corona charging apparatus, optimization of the corona charging apparatus being in part dependent upon the selected charger grid having a predetermined voltage applied to the grid electrodes.

It is further an additional object of the present invention to provide an optimal corona charging apparatus and method that will charge biological substances, inclusive of organisms, foodstuffs, and blood, where the charging is utilized in a medical treatment of the biological substance, optimal charging is accomplished using corona in a convecting gaseous fluid and where charging is accomplished in part by conduction and induction due to transport of ionized and polarized molecules of the gaseous fluid and in part by induction from a charger grid of the corona charging apparatus, optimization of the corona charging apparatus being in part dependent upon the selected charger grid having a predetermined voltage applied to the grid electrodes.

These, and additional objects, advantages, features and benefits of the present invention will become apparent from the following specification.

BRIEF DESCRIPTION OF THE DRAWINGS

FIG. 5 is a schematic of a preferred apparatus according to the present invention to provide an electrostatically charged filtration device.

FIG. 6 is a sectional side view of an apparatus according to the present invention for providing an electrically charged aerosol delivery device.

FIG. 7 is a schematic of a preferred apparatus to provide a charged aerosol.

DETAILED DESCRIPTION OF THE PREFERRED EMBODIMENTS

Figure 1:
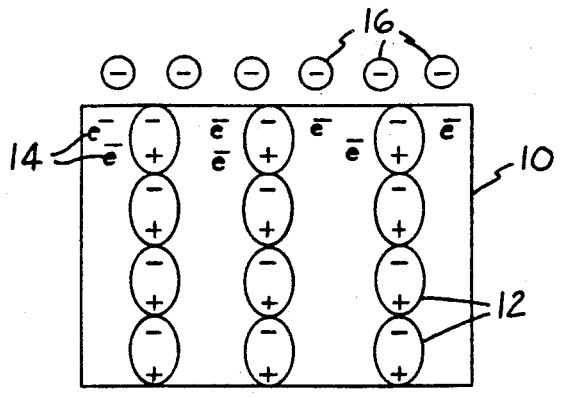
FIG. 1 is a schematic depiction of a cross-section of a polymer film, showing the nature of the electrical charges that are responsible for the electrical field produced by an electret.
Figure 2:
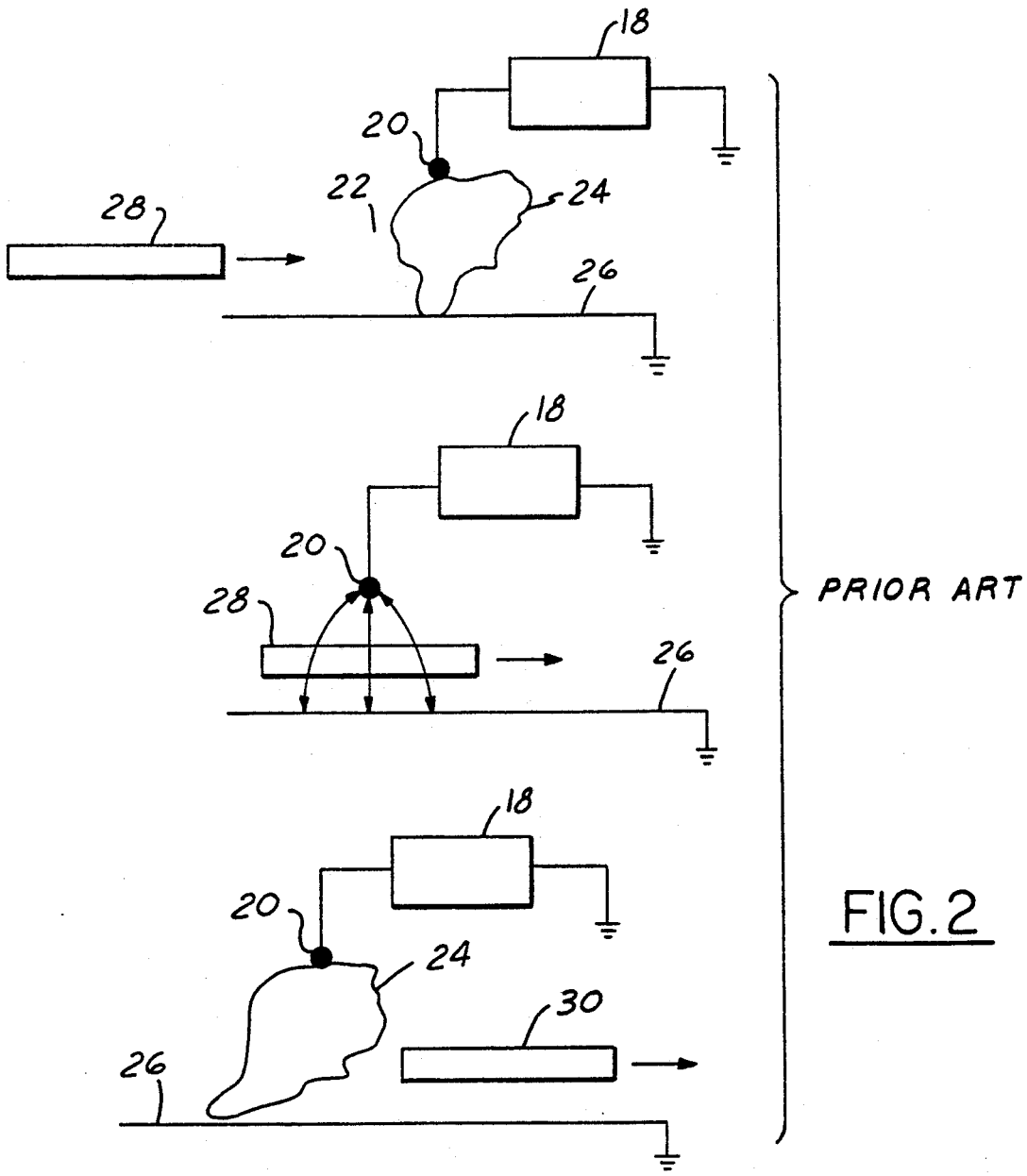
FIG. 2 is a schematic depiction of the prior art method of producing an electret from roll mill polymer film; the upper, middle and lower drawings showing the progressive movement of the roll mill polymer film through a conventional corona charger.
Figure 3:
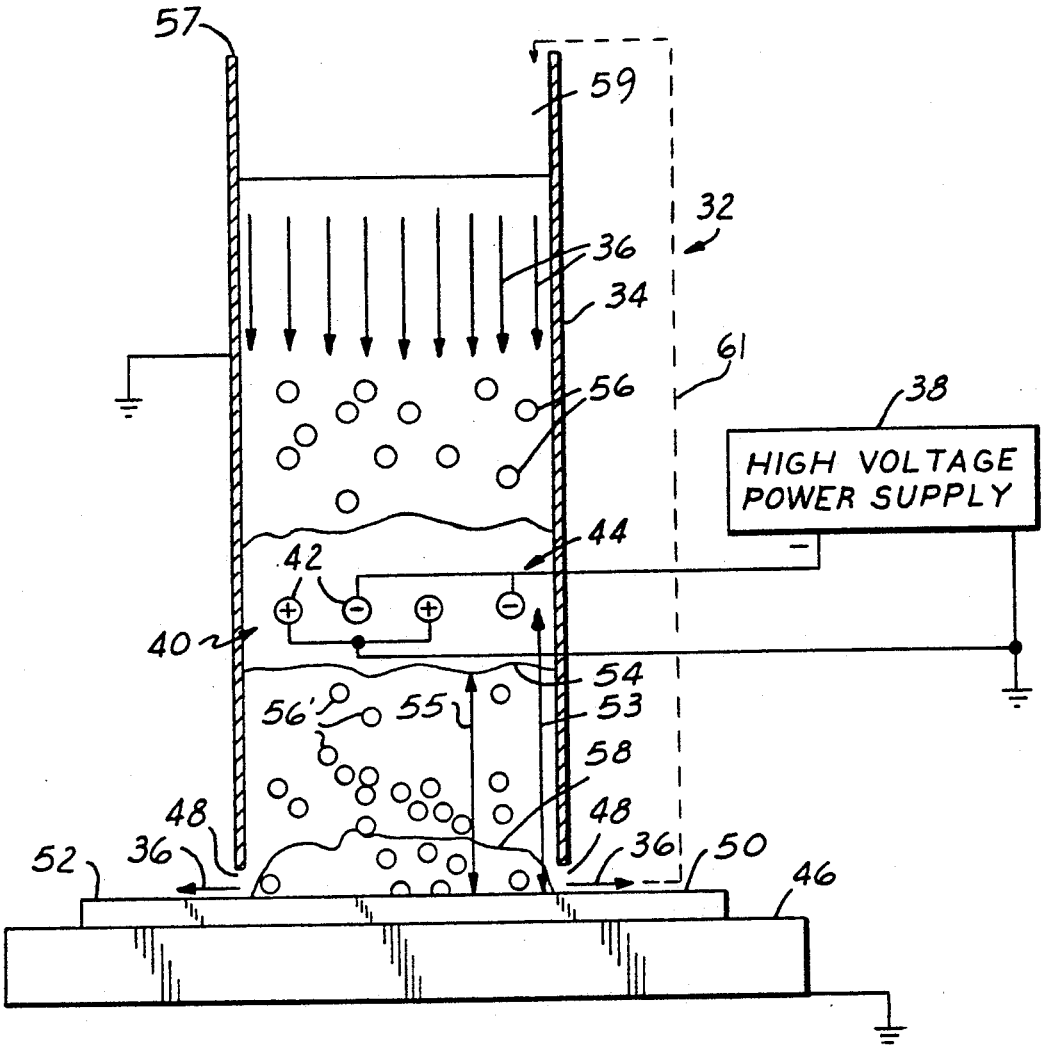
FIG. 3 is a partly sectional side view of the receptor charger apparatus according to the present invention, wherein a gaseous fluid flows past a novel charger grid and then over the surface of a receptor in the form of a roll mill polymer film.
Figure 4:
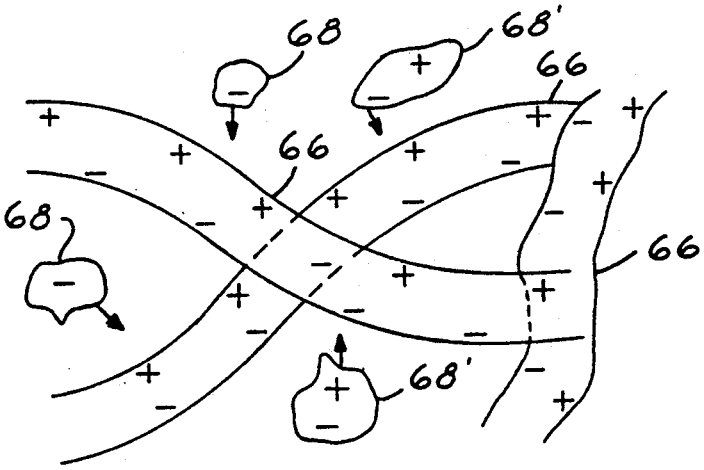
FIG. 4 is a detail schematic depicting how an electret filter media can efficiently remove debris by electrostatic processes in addition to mechanical processes.

Referring now to the Drawing, FIG. 3 generally shows a receptor charger apparatus 32 for carrying out the present invention. As indicated above, the purpose of the present invention is to provide 1) an apparatus that is optimally configured for charging a receptor in the commercial production of electrets, and 2) provide a charged gaseous fluid by passage of a gaseous fluid through an optimally electrified charger grid which creates an optimal corona in the gaseous fluid. The receptor charger apparatus 32 is composed, generally, of a housing 34, a supply of flowing gaseous fluid 36 entering into a first end 57 of the housing, a kilovolt D.C. power supply 38, a multi-electrode charger grid member 40 whose charger grid 44 is electrically connected with the kilovolt power supply so that, preferably, the grid electrodes 42 of the charger grid 44 each alternate in polarity, a grounded conductive base plate 46 located adjacent the second end of the housing, and a relief passage 48 for placement of a receptor 50 between the second end of the housing and the base plate, as well as for passage of the flowing gaseous fluid 36 out of the housing 34 and over the receptor 50. For the sake of brevity hereinafter the term "air" will be used instead of "gaseous fluid"; however, it is understood the the word "air" as used hereinafter refers to any gaseous fluid, such as, but not limited to, nitrogen or atmospheric air. Also, for the sake of brevity, the term "receptor" is used to describe anything that can acquire charge via the apparatus herein described, such as, but not limited to, mill roll polymer film, other polymers, fibers, particles, paints, gaseous fluids, liquid fluids and biological things, including specimens and organisms of all kinds. It should further be noted that the charger electrodes should have an optimal geometry for providing a maximum, uniform corona in the gaseous fluid, including wires, spheres, knife edges and needle points. Thus, FIG. 3 may be interpreted as potentially showing any of these as geometries for electrodes 42, but that wires are shown as they are preferred. For the sake of clarity of exposition herein, "conductive" or "non-conductive" herein refers to electrical properties of the material under consideration, and "charge" refers to an excess electrical charge of a material under consideration, either of a net positive or negative polarity. Also, it is to be understood that the term "receptor" as used herein includes solids and fluids and can be anything, either inert or biologic, inclusive of radioactive materials.

An important concept of operation of the receptor charger apparatus 32 according to the present invention is to provide a stable corona that is available at all times whether or not the receptor 50 is in its position for charging (as shown in FIG. 3) or not. In order to achieve this result, the charger grid 44 is located a predetermined optimum distance 53 from the surface 52 of the receptor 50. This predetermined optimum distance 53, which shall hereinbelow be referred to as the "gap", will be elaborated in detail below. As a result of the location of the charger grid 44 at the predetermined optimum distance from the receptor surface 52, a corona 54 can be established in the housing adjacent the grid electrodes 42 which is not diminished by the presence of the receptor. Further, the charger grid 44 is optimized in that each grid electrode 42 is everywhere equidistant with respect to its adjacent grid electrode across the cross-section of the housing, as well as being equidistant with respect to the receptor 50. Preferably, sequentially across the charger grid, the polarity of the grid electrodes alternates; that is, positive, negative, positive, negative, etc. This alternation of the polarity of the grid electrodes has been demonstrated in the experiment elaborated below to provide superior corona establishment, as compared with the mere utilization of all-alike polarity grid electrodes, although this can be used, too. The reason for this result is that by using alternate polarity grid electrodes the electrical field interaction between adjacent grid electrodes readily induces ionization in the molecules 56 of the surrounding air, thereby efficiently creating the corona 54. Details of the structure of a tested charger grid member 40 will be discussed in detail hereinbelow with regard to FIGS. 8A through 10.

From the foregoing description of the preferred embodiment, it is to be understood that the break-through with respect to the present invention is the structural configuration that is necessary to provide an optimum corona envelope within a flowing gaseous media (inclusive of aerosols). This is achieved by: 1) structuring the charger grid electrodes to provide a maximum, uniform electric field therebetween, as by providing a plurality of geometrically optimized electrodes, each adjacent electrode being everywhere equidistantly spaced, 2) structuring the charger grid electrodes so that contamination build-up is very unlikely, as by providing small cross-section electrodes between which the electric field is created—no corona interaction with an adjacent plate or other large electrode surface being permitted, 3) optimizing electrification voltage and polarity of the charger grid electrodes, as by alternate polarity between adjacent electrodes, and finally, 4) structuring the charger grid so that corona uniformly covers the cross-section of flow of the gaseous fluid within the housing, as by appropriate location of the charger grid electrodes. With regard to the preceding remarks, it should be noted that a significant aspect of the present invention is its non-susceptibility to contamination because no large scale electrode surfaces are involved. Accordingly, electrodes in the form of knives, needles and wires are possible, but in any such geometry, the area of the electrode should be minimized to reduce contamination susceptibility. Also, the installation of needles are ergonomically more work intensive, during manufacture of the charger grid, as compared to the installation of wires. Thus, a wire geometry would be favored over a knife or a needle geometry. Further with regard to the preceding remarks, it should be noted that another significant aspect of the present invention is that by utilizing a plurality of electrodes as the sole source of the electric field driving the corona, it is relatively easy to ensure that there is equidistant spacing between adjacent electrodes. If equidistant spacing were not everywhere provided between adjacent electrodes the electric field would congregate almost entirely at the closest point of approach, thereby compromising the corona everywhere else. Thus, by not using a large scale electrode, such as a cylinder or a plate, uniformity of the corona is easier to achieve and maintain. Still further with regard to the preceding remarks, it should be noted that another significant aspect of the present invention is that by utilizing only a plurality of discrete charger grid electrodes air flow is essentially unrestricted through the charger grid. Thus, the present invention is advantageous over prior art structures which utilize transverse electrode structures, such as perforated plates.

The method of operation of the present invention will now be detailed.

Molecules 56 of the air 36 are introduced into the housing at a predetermined flow rate (which will be elaborated below) via a pump agency system 59, such as a fan, compressor, blower or other conventional device of the like, and which may also include metering and filtering devices, as well. The molecules flow through the charger grid 44. The molecules are thereupon subjected to electrical forces by the kilovolt voltage applied to the grid electrodes 42. As a result, the molecules become charged either by polarization or by ionization. These charged molecules 56' then flow toward the second end of the housing, and eventually exit at the relief passage 48. If desired, the exit flow 36 can be re-cycled back to the first end 57 of the housing, as shown by the dashed path 61. At the relief passage is located the receptor 50 that is to be converted into an electret. The charged molecules 56' bombard the surface 52 of the receptor, thereby causing space charges to be induced and for surface charges to be deposited and, further, causing polarization by induction resulting from the immediately adjacent region 58 of turbulent movement of the charged molecules 56'. Adding to the inductive forces of the charged molecules 56' is induction due to the corona 54 as well as the charger grid 44, the corona being spaced from the surface 52 of the receptor a distance 55 which allows for an inductive interaction therebetween. It is desired that the distance 55 be predetermined so that induction is optimized, yet spark over due to dielectric breakdown of the receptor is prevented. The location of the receptor can be such as to allow for the corona to touch it, provided dielectric breakdown of the receptor does not occur.

The conductive grounded base plate 46 has several purposes. Firstly, it provides an agency to hold the receptor 50 at a precise location relative to the charger grid 44. It should, however, be noted that it is alternatively possible to separate the base plate from the receptor. Secondly, a conductive base plate may be electrified to a predetermined voltage with a preselected polarity (including simple grounding) in order to affect the electric field through the receptor when it is being charged by the corona, thereby making a contribution to its final charge state. Thirdly, it enhances safety. In the event there might be spark-over between the charger grid 44 and the base plate, the fact that the base plate 46 is conductive and grounded will ensure that any dangerous voltage will harmlessly dissipate. Further, it is also possible to replace the conductive base plate with a non-conductive one. Indeed, operation of the receptor charger apparatus 32 can proceed without inclusion of the base plate 46.

Examples of gaseous fluid charger apparatus are given in FIGS. 4 through 7. In a first example, shown in FIGS. 4 and 5, a gaseous fluid charger apparatus 33 uses the charger grid member described above now used as a pre-charger 60 to charge in-coming contaminated air 62 to an electrostatic filter device 64, from which clean air 65 emerges. Alternatively, only a first stream of clean air may be sent through the pre-charger 60, to be later met by a second stream of contaminated air, mixing occurring before the contaminated air and charged clean air encounter the filter device 64. The filaments 66 of the electrostatic filter device are electrets which capture the net charged contaminants 68 and polarized contaminants 68'. Indeed, the charge carried by the contaminants is collected at the electret filaments 66, thereby providing additional charge centers for trapping further in-coming contaminants. Alternatively, the electrostatic filter media may be charged by being sandwiched between high voltage bearing electrodes, or by being placed inside or proximate to the corona. In a second example, shown in FIGS. 6 and 7, a gaseous fluid charger apparatus 35 is used in conjunction with water based and organic based aerosols, such as those encountered in 1) paint spraying and 2) aeration for waste water treatment. In this example, the charger grid 44 is used as a pre-charger 70 to charge in-coming air 72. In the particular structure shown in FIG. 6 for water base or organic base paint applications, in-coming gas 72 (in this case air) enters a housing, passes the charger grid 44 and then becomes charged by being ionized and polarized. This charged air then mixes in the device 74 with an in-coming water base or organic base paint liquid 76, whereby the water base or organic base paint liquid and air form a charged aerosol 78 (or charged spray paint). The intention is that a charged spray paint would have better adhering characteristics than uncharged spray paint. Indeed, a significant break-through of the apparatus and method according to the present invention is that conductive and non-conductive liquids can be electrostatically charged and then processed in a device.

Discussion will now detail the various considerations to be analyzed when determining the preferred dimensions and configuration for providing an optimized charger apparatus 32 for making electrets from a receptor. Please refer now to FIGS. 8A through 15.

Figure 8A:
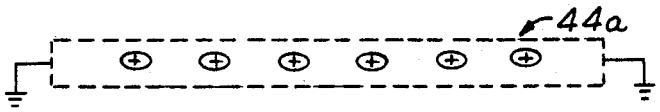
FIGS. 8A, 8B and 8C are side views of preferred alternative charger grid configurations.
Figure 8B:
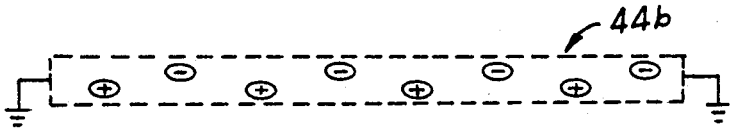
Figure 8C:
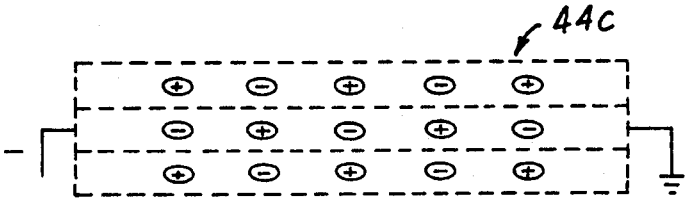

FIG. 8A depicts an alternative charger grid scheme **44*a* in which all the grid electrodes are of the same polarity. FIG. 8B depicts yet another charger grid scheme 44*b* in which the grid electrodes are of alternate polarity, and further, are now also alternately vertically displaced relative to the receptor (not shown). FIG. 8C depicts an alternative charger grid scheme 44*c* in which a charger grid scheme of the kinds hereinabove described (44, 44A and 44B**) are now layered, so that in-coming air will encounter them serially. This latter charger grid structure is best suited for large charging process applications. These alternative charger grid schemes are presented herein to assist those skilled in the art to construct a charger grid having maximum efficiency under particular operating conditions, and each is contemplated for use in the present invention.

Figure 9:
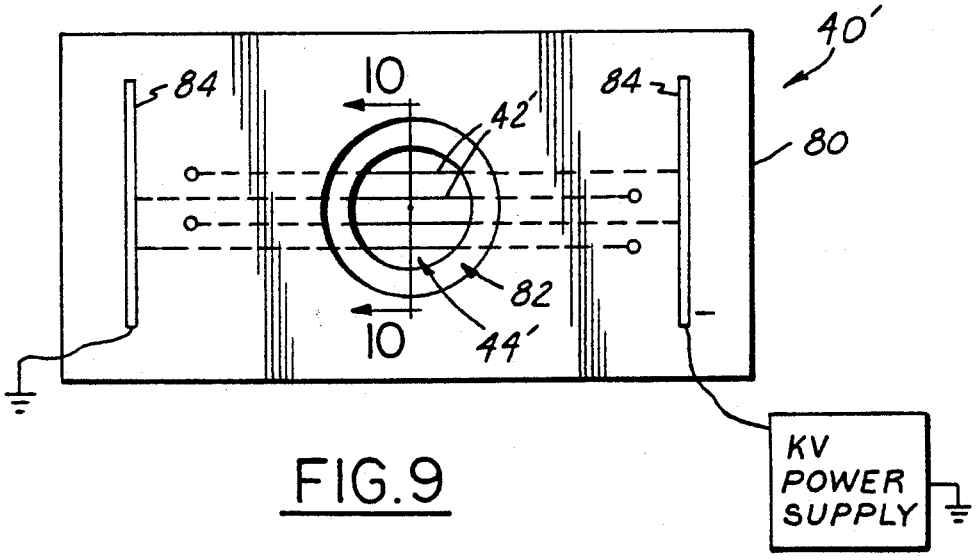
FIG. 9 is a top view of a preferred configuration for the charger grid according to the present invention.
Figure 10:
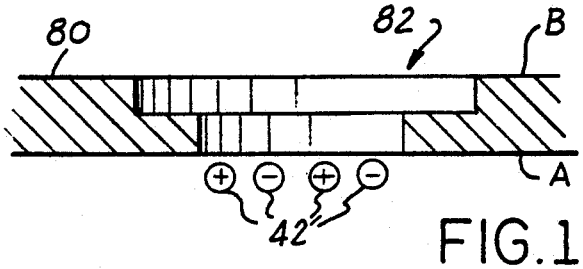
FIG. 10 is a sectional side view of the preferred configuration of the charger grid according to the present invention.
Figure 11:
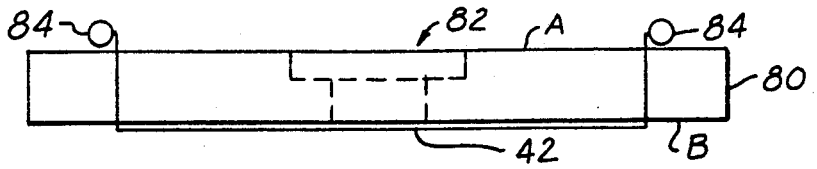
FIG. 11 is an end view of the preferred configuration of the charger grid according to the present invention.

FIGS. 9 through 11 detail the construction of a test charger grid member 40' that was used to test and define performance optimization of the charger apparatus 32. The test charger grid member 40' is constructed of the following components. A mounting plate 80 composed of poly-vinyl-choride (PVC) material that is 0.25 inch thick and has a center bore 82 that is 2 inches in diameter at end A and 2.375 inches in diameter at opposite end B. A brass buss rod 84 is provided on the mounting plate 80 at either side of the center bore 82. Four grid electrodes in the geometry of grid wires 42' are stretched across the center bore, forming the charger grid 44'. The grid wires are electrically connected so that alternate grid wires connect to one, then the other, of the brass buss rods. The grid wires 42' are constructed of standard 4 mil tungsten wire stock. The actual number of grid wires used will depend upon the area of surface of the receptor to be charged, for the 2 inch center bore used, four grid wires were deemed sufficient to provide a stable, generous sized corona. Also, the wire diameter and wire spacing can be adjusted to provide a selected corona strength. One of the brass buss bars is connected to the positive side of the kilovolt power supply 38, while the other brass bus bar is connected to ground. In the present example, it was desired to use ground as the equivalent of positive polarity for the charger grid, in that is was determined that a negative kilovoltage applied to every other grid wire produced an optimal corona.

Figure 12:
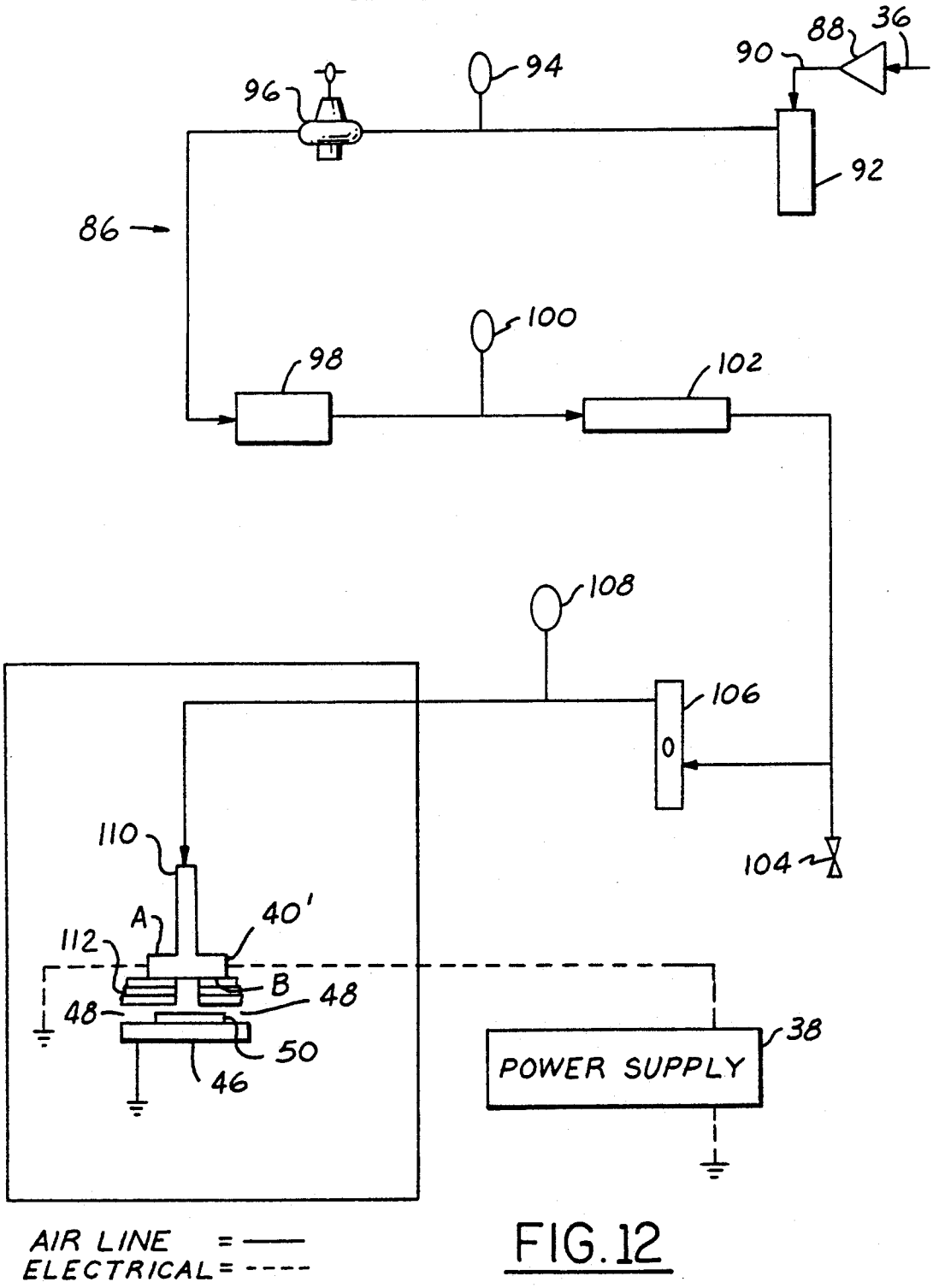
FIG. 12 is a schematic depiction of the apparatus set-up for the charger apparatus according to the present invention.
Figure 13:
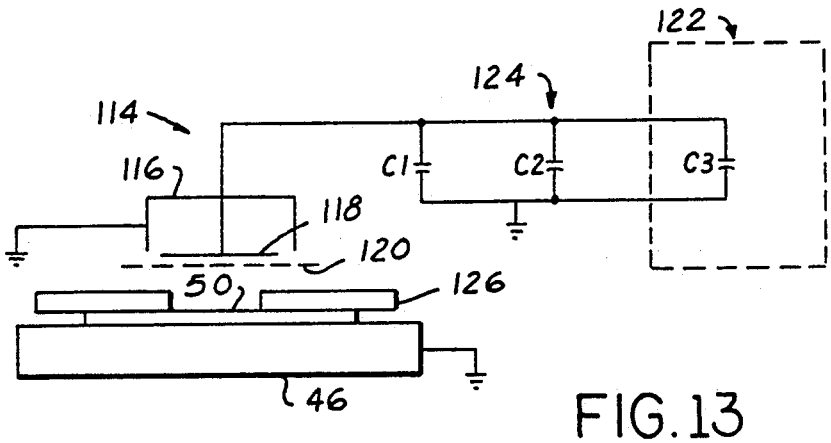
FIG. 13 is a schematic depiction of an apparatus used to test the charger apparatus according to the present invention.

FIG. 12 depicts schematically the over-all set-up configuration of the charger apparatus 32. An air supply group 86 is composed of and functions as follows: air 36 is delivered by a pump 88 along piping 90 to an air coalescer 92, past a pressure gauge 94, a pressure regulator 96, an air purifier 98, another pressure gauge 100, an air filter 102, a flow regulator 104, a flow meter 106, and then finally to another pressure gauge 108. The air supply group 86 is then connected to a manifold which serves as an upper portion of what would be the housing 34 in FIG. 3. Connected to the manifold at its downstream end is the wider diameter portion of the center bore 82 of the mounting plate 80. Air passes through the center bore, through the charger grid 44' (not shown) of the charger member 40', and then into a space defined by insulative spacer plates 112, all of which serving as the lower portion of what would be the housing 34 of FIG. 3. The receptor 50 is located at a relief passage 48, and rests upon a conductive base plate 46 that is grounded. The charger grid is electrically connected as indicated immediately above.

Tests on the hereinabove described configuration of the charger apparatus 32 utilized a sensor apparatus 114 to measure the amount of charge held by an electret that was produced by charging a receptor 50 in the form of a piece of roll mill polymer film. The sensor apparatus is electrically grounded, using a metallic enclosure (not shown). The sensor apparatus is composed of a sensor 116 having a metallic probe plate 118, a grounded metallic shutter 120 for selectively shielding the metallic probe plate from any electrical field due to the electret, an electrometer 122 for registering any change in electrostatic force on the metallic probe plate and an electronic circuit 124 for connecting the sensor 116 to the electrometer 122. To improve performance of the sensor, a grounded metal flange 126 was employed to minimize end effects.

Figure 14:
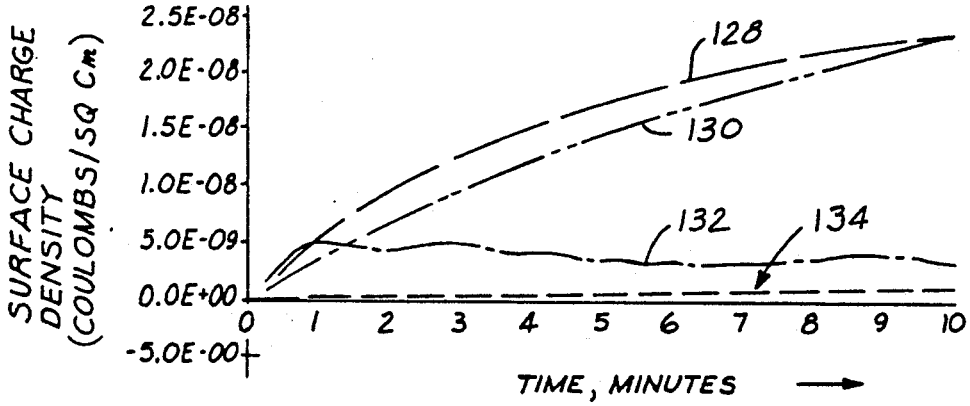
FIGS. 14 and 15 are test results performed on the charger apparatus according to the present invention, indicating optimization parameters.
Figure 15:
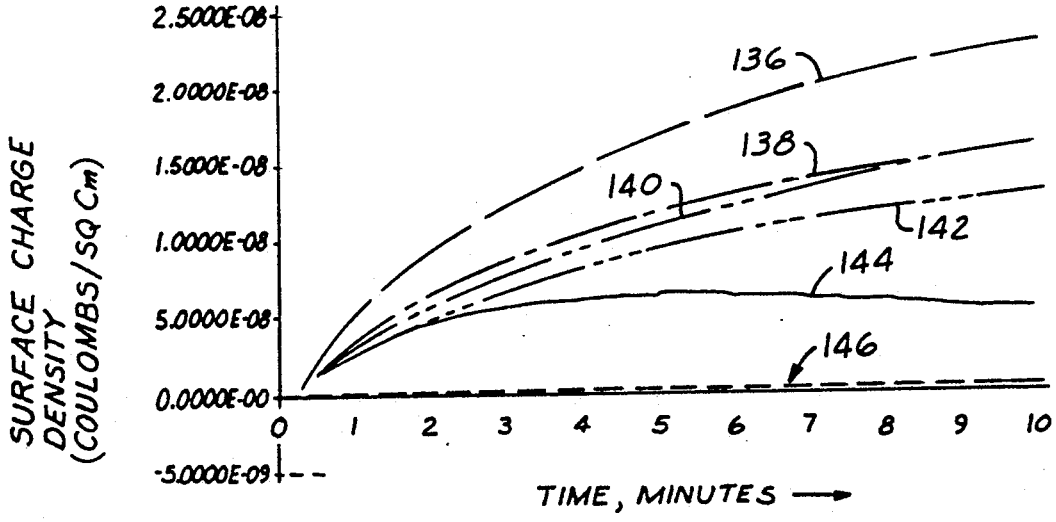

Results of 55 tests are registered in FIGS. 14 and 15. For these tests, parameters were set, generally, as follows: air flow rate at between zero and 20 liters per minute; voltage on the charger grid wires at between 8 to 10 kilovolts, nominally 8.5 kilovolts; charger current draw at between 0.1 and 0.2 milliamperes, nominally 0.1 milliamperes; receptor exposure time to charger grid voltage at 10 minutes for each test; and gap separation between the grid wires 42' and the surface 52 of the receptor at between 0.09 and 2.14 centimeters. For the sake of clarity of description, the receptor 50 when charged by the apparatus and method according to the present invention shall hereinbelow be referred to as the "electret", and when uncharged, simply as the "receptor".

FIG. 14 indicates the accumulated surface charge density of the electret for tests involving various flow rates as a function of time. The separation gap between the charger grid and the surface of the electret is constant for all tests, set at 0.32 centimeters. Curve 128 represents the electret for a flow rate of 10 liters per minute; curve 130 represents the electret for a flow rate of 20 liters per minute; curve 132 represents the electret for a flow rate of zero liters per minute; and the remaining curves 134 represent the corresponding base line readings for the three flow rates before charging the receptor. It will be seen from examination of these curves that flow rates of approximately 10 liters per minute and higher (within the flow rate limits of the test, at least) produce much enhanced charging over that which can be expected where no flow rate is involved (the no flow rate situation being essentially the conventional method alluded to in the section Background of the Invention, discussed hereinabove). Thus, conclusion can be drawn that flow rates approximately 10 liters per minute can deliver an optimum charge, depending on specific charger structural configuration.

FIG. 15 indicates the accumulated surface charge density of the electret for tests involving various separation gap distances 53 between the charger grid and the surface of the electret as a function of time. In this series of tests, the flow rate was kept constant at 10 liters per minute. Curve 136 represents the electret for a gap of 0.32 centimeters; curve 138 represents the electret for a gap of 2.14 centimeters; curve 140 represents the electret for a gap of 0.09 centimeters; curve 142 represents the electret for a gap of 0.87 centimeters; curve 144 represents the electret for a gap of 1.27 centimeters; and the remaining curves 146 represent the corresponding base line readings for all gaps before charging the receptor. It will be seen from examination of these curves that optimization of the charge density of the electret is achieved for an intermediate gap distance of 0.32 centimeters (curve 136). This gap distance would therefore define the optimum predetermined gap distance mentioned above for a charger apparatus as exemplified above. However, the over-all geometrical considerations of any charger apparatus 32 must be taken into account to determine the optimum predetermined gap distance 53 for any other charger apparatus 32. It is believed that when the gap is too small, air can't flow easily over and away from the polymer; and that when the gap is too large, the charger grid is simply too far away to achieve best results, which may be linked to inability to induce polarization and also due to decay of molecular charge in the flowing (convecting) air due to the large gap distance. Too, the distance 55 between the corona and the surface of the electret (or receptor) must be considered as hereinabove detailed in order to assure prevention of spark-over and/or damage to the electret (or receptor).

Particular applications of the present invention will now be described with reference now being directed to FIGS. 16 through 20.

Figure 16:
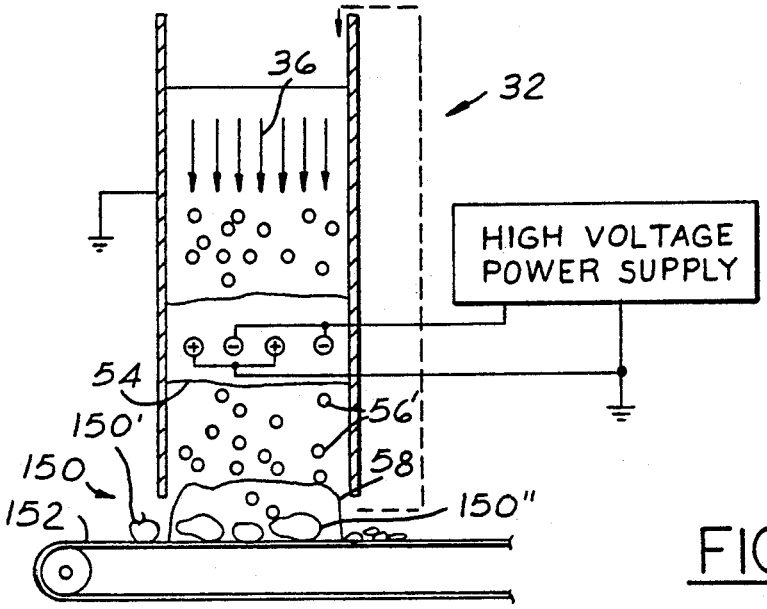
FIG. 16 is a partly sectional side view of the receptor charger apparatus shown in FIG. 3, shown in operation charging a receptor in the form of various biological substances.

FIG. 16 depicts the apparatus described in detail above with respect to FIG. 3, now being utilized to charge a receptor in the form of biological substances 150. Biological substances can be in any form, including whole organisms, or parts thereof, from the animal and plant kingdoms, as well as tissues, such as tumors. The biological substance 150 is delivered to the charger apparatus 32 by any reasonable means calculated to minimize adverse affect on the corona, here shown to be a conveyer apparatus 152. Exposing a biological substance to the charge region 58 via the charged molecules 56' induces charge on the biological substance. This charge serves to treat the biological substance (particularly the surface thereof) against bacteriological growth, such as on an apple 150' or a potato 150''. Such a treated biological substance freed of bacterial growth can have many advantages, such as preservation of foodstuffs, as well as disinfection against disease.

The corona 54 itself may directly contact the biological substance in order to facilitate a maximum antibacteriological effect. Further, the biological substance may be repeatedly sent past the charger apparatus 32 as many times as needed to insure a desired level of antibacterial processing. Further, the application of charge to the biological substance can have an antiviral action in that the cellular processes supporting the virus are altered by charging the biological substance.

Figure 17:
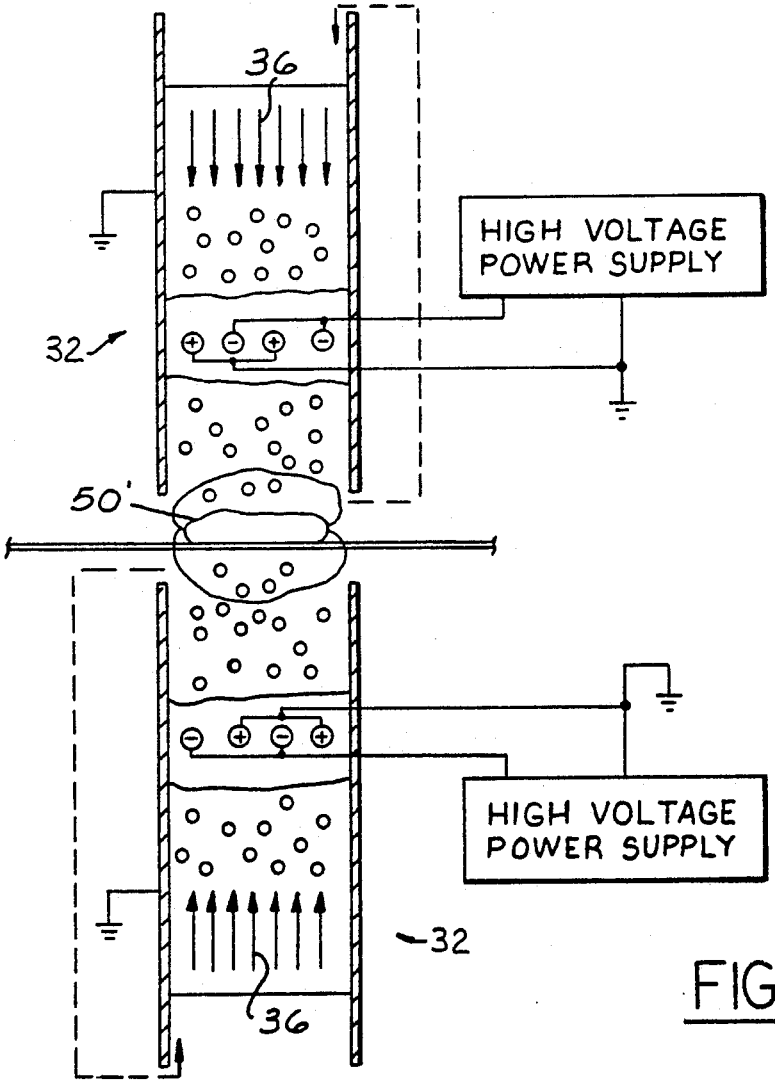
FIGS. 17 and 18 are partly sectional side views of the charger apparatus according to the present invention, now including multiple chargers for charging a receptor.
Figure 18:
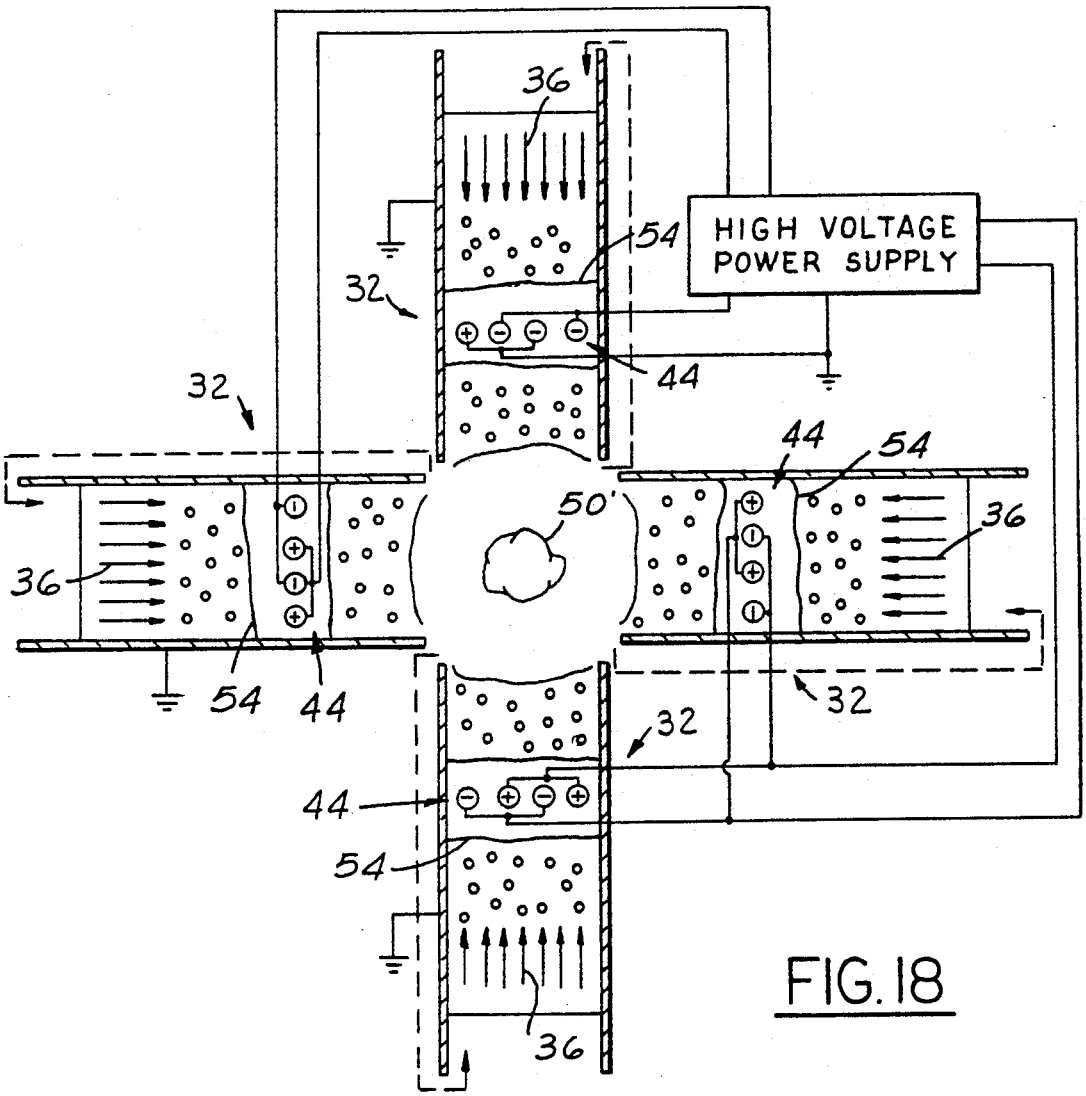

Turning now to FIGS. 17 and 18, it will be seen that multiple numbers of charger apparatus 32 can be combined to produce multiple streams of charged molecules and thereby enhance the effectiveness of the charge region 58 to charge a receptor 50'. In this respect, any number of charger apparatus can be combined along any mutually respective axial relationship. Particularly, by utilizing multiple charger apparatus 32 along differing orientations, optimal engulfing of the receptor 50' in the charging region is ensured. Again, multiple passes of the receptor may be utilized to maximize the desired charging effect. Movement of the receptor relative to the charger apparatus can be effected either by the charger apparatus moving or by the receptor moving.

Figure 19:
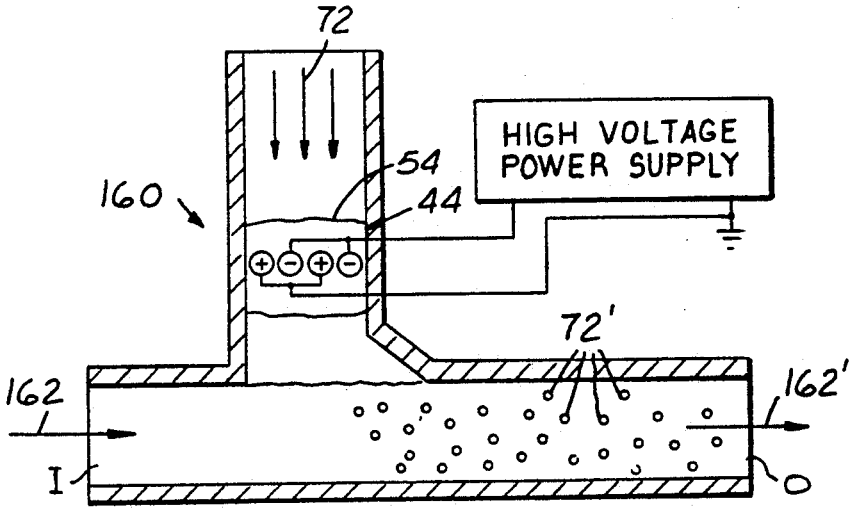
FIG. 19 is a partly sectional side view of a charger apparatus according to the present invention for charging a fluid stream in the form of a liquid, particularly a biological liquid, such as blood.
Figure 20:
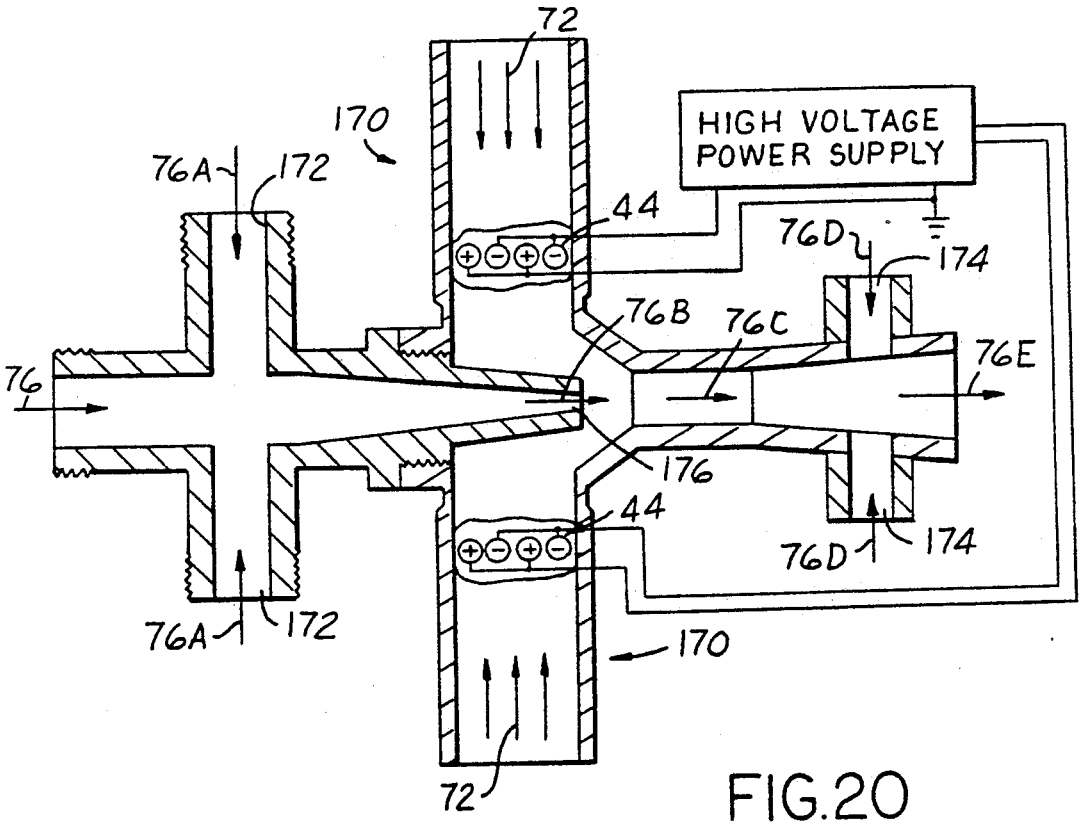
FIG. 20 is a partly sectional side view of a modification of the charger apparatus shown in FIG. 6, now including optional auxiliary fluid inlets into the uncharged fluid before the charged fluid inlet, and further including optional auxiliary fluid inlets after the charged fluid inlet.

Referring now to FIGS. 19 and 20 the discussion will now embrace applications involving charging applications relating most specifically to fluids.

FIG. 19 depicts a charger apparatus 160 structured for the treatment of a fluid 162. The fluid 162 can be any gas, liquid or aerosol, but for the purposes of this charger apparatus 162, the preferred fluid is a liquid. The liquid can be anything, including blood or other biological liquids, molten plastic, paint having a base of water, petroleum or another base, liquid polymer composites, molten substrates, combustible liquids, and water. The fluid 162 mixes with the in-coming gas 72 after the in-coming gas has been charged by the charger grid 44 via bubbles 72', whereby charge is transferred from the charged air to charge the fluid, resulting in a charged fluid 162'.

As a particular example of operation, consider utilization where the liquid 162 is waste water having suspended therein undesirable bacteriological organisms. The waste water flows into and out of the charger apparatus 160 and in so doing between locations I and O is thereby exposed to electrostatic charging by mixing with the in-coming gas 72 after the in-coming gas has been charged by the charger grid 44, which effects to provide an antibacteriologic benefit to the waste water that serves to at least partially disinfect the waste water. This can reduce the need for disinfection chemicals in water treatment situations, such as those used for drinking water and swimming pools.

As a second particular example of operation, consider utilization where the liquid 162 is blood. Blood having need for medical treatment either because of a bacteriological or viral infection may be treated by mixing with the in-coming gas 72 after the in-coming gas has been charged by the charger grid 44, to lessen or cure the infection via exposure to charge. In theory, this process is effective because the cellular function is altered by the charging of the blood, thereby resulting in an antibacteriological and/or antiviral action. As an example, blood containing the human immunodeficiency virus (HIV) responsible for "AIDS" may be treated utilizing exposure to charge.

As a third particular example of operation, consider utilization where the liquid 162 is a liquid base paint, such as paint of a water base or a petroleum base. The liquid base paint passes through the nozzle either as a liquid stream or an aerosol to mix with the in-coming gas 72 after the in-coming gas has been charged by the charger grid 44, thereby creating a charged liquid (and/or charged aerosol) base paint. In contradistinction with the present invention of providing a charged paint, the conventional method of direct charging of paint requires use of a non-conductive fluid (non-water base paint) in order that the electrodes of the charger not short. The present invention of indirect charging advantageously may be used with either conductive or non-conductive liquids. Further, the present invention offers safety advantages over the conventional direct charge method where the paint must directly pass through the grid electrodes, a hazard if the paint is at all combustible.

As a fourth particular example of operation, consider utilization where the fluid 162 is a combustible fluid, such as gasoline. The in-coming gas 72 after being charged mixes with the combustible fluid to form a charged combustible fluid. Advantageously, the combustible fluid is charged without having to contact the electrode grid of the charger. The electrodes can also act as a spark plug to intentionally initiate combustion of the combustible fluid.

FIG. 20 shows a variation in the apparatus depicted in FIGS. 6 and 19. One or more chargers 170 may be utilized and the incoming fluid 76 is pre-mixed with at least one other additional fluid 76A via one or more primary inlets 172. Thus, a mixed fluid 76B will thereupon mix with the in-coming gas 72 after the in-coming gas has been charged by the charger grid 44, resulting in a charged mixed fluid 76C. Further, secondary inlets 174 may be added so that a second additional fluid 76D may be added to the charged mixed fluid to thereby result in a final multiply mixed charged fluid 76E. In this regard, the additional fluids 76A and 76D may be medicines or other treatment fluids for the incoming fluid 76. Further, the structure of the housing of the apparatus, the nozzle 176 and of the inlets 172, 174 is such that the particular treatment desired is optimized based upon the physical conditions involved, to wit:- pressure, temperature, flow rates, viscosity, corona location, chemical compositions, desired droplet size, etc. The multiply mixed charged fluid 176E may be thereupon recycled through the charger apparatus.

Further, the nozzle 176 can be substituted by an extruder. In this case, the incoming fluid 76 is a molten polymer that is extruded. The extruded molten polymer thereupon becomes charged fibers upon mixing with the in-coming gas 72 after the in-coming gas has been charged by the charger grid 44. The present invention may advantageously be used to treat fiber surfaces, including the charging of fiber webs and the preparing of fiber surfaces for further applications, such as stain resistance. The present invention has advantageous application to the preparation of polymer powders and adhesives, particularly deposition of charged powders or adhesives onto charged fibers. An example is the deposition of charged polymers into charged fiber glass mats during preparation of polymer composites. Charged polymers may be deposited on other fibers, as well, such as nylon.

Further, the present invention has advantageous application to the charging of plastic surfaces prior to painting, and particularly the charging of the plastic surface and the paint so that application of the paint to the plastic surface is controllable with great precision.

Further still, it is understood that charging of biological substances in order to treat them antibacteriologically and/or antivirally is basable upon interaction with corona and/or moving ions, inclusive of induction and/or convection. Further, still, it is to be understood that the physical and chemical properties of the bacteria, and/or viruses, and or host biological substance will be influenced antibacteriologically and/or antivirally in a manner directly related to charging and/or indirectly related to charging; these influences being specifically related to cellular ion transportation resulting in chemical diffusion and/or chemical reactions which result in the antibacteriological and/or antiviral action.

Further yet, it is to be understood that the charging processes described herein include charging due to corona, ions, field and radiation.

It is to be understood by those skilled in the art that any reference to a "non-aerosol" fluid refers to a fluid substantially free of particles.

To those skilled in the art to which this invention appertains, the above described preferred embodiment may be subject to change or modification. In this regard, it is to be understood that the grid electrodes can be of a circular, triangular, square or other cross-section and may be of a helical or other configuration. Further, the electrode number and spacing, geometry, wire cross-section, fluid conditions (physical and chemical), receptor conditions (physical and chemical), surrounding environment, relative movement of the receptor, corona location, and other charge defining parameters can be varied in order to optimize the desired electrostatic charge effect. Such change or modification can be carried out without departing from the scope of the invention, which is intended to be limited only by the scope of the appended claims.

What is claimed is:

1. An apparatus for optimally electrically charging a receptor, said apparatus utilizing a gaseous fluid, said apparatus comprising at least two receptor chargers, each said receptor charger comprising:

a housing having a first end and a second end;

a charger grid member connected with said housing, said charger grid member comprising a plurality of charger grid electrodes, adjacent charger grid electrodes of said plurality of charger grid electrodes being uniformly mutually separated a predetermined distance, said plurality of charger grid electrodes forming a charger grid within said housing between said first end and said second end thereof;

kilovoltage means electrically connected with said charger grid member for selectively electrifying said plurality of charger grid electrodes so as to produce a substantially uniform electric field therebetween, said electric field exclusively establishing a corona in the gaseous fluid, spacing and voltage difference between each adjacent charger grid electrode of said plurality of charger grid electrodes cooperating with a predetermined geometry of said plurality of charger grid electrodes to provide an electric field having an electric field strength between adjacent charger grid electrodes that is below that electric field strength which would result in spark-over between said adjacent charger grid electrodes;

gaseous fluid mover means for moving the gaseous fluid at a predetermined flow rate through said housing between said first end and said second end thereof;

positioning means adjacent said second end of said housing for positioning the receptor at a predetermined location relative to said charger grid; and gaseous fluid port means located adjacent said second end of said housing for allowing the gaseous fluid to exit said second end of housing while simultaneously moving over the receptor;

wherein said charger grid provides a substantially uniform corona across a cross-section of said housing and imparts a charge onto the gaseous fluid as the gaseous fluid moves from said first end of said housing to said second end of said housing, and the gaseous fluid thereupon at least in part contributes to optimal charging of the receptor as the gaseous fluid exits said housing; further wherein each receptor charge is oriented with respect to the receptor so that said at least two receptor chargers collectively provide charge thereto.

2. The apparatus of claim 1, wherein said electric field strength is at least substantially near, but not including, that electric field strength which would result in spark-over between said adjacent charger grid electrodes.

3. The apparatus of claim 2, wherein said at least two receptor chargers are mutually located with respect to each other and the receptor so as to fully engulf the receptor in corona.

4. The apparatus of claim 3, further wherein said port means on at least one of said at least two receptor chargers is for routing a predetermined portion of said gaseous fluid exiting said second end of said housing back to said first end of said housing.

5. An apparatus for providing an electrically charged non-aerosol gaseous fluid for mixing with a second fluid to form an electrically charged third fluid, said apparatus comprising:

at least one charger comprising:

a first housing having a first end and a second end;

a charger grid member connected with said first housing, said charger grid member comprising a plurality of charger grid electrodes, adjacent charger grid electrodes of said plurality of charger grid electrodes being uniformly mutually separated a predetermined distance, said plurality of charger grid electrodes forming a charger grid within said first housing between said first end and said second end thereof;

kilovoltage means electrically connected with said charger grid member for selectively electrifying said plurality of charger electrodes so as to produce an electric field therebetween, said electric field exclusively establishing a corona in a surrounding gaseous fluid, spacing and voltage difference between each adjacent charger grid electrode of said plurality of charger grid electrodes cooperating with a predetermined geometry of said plurality of charger grid electrodes to provide a substantially uniform electric field having an electric field strength between adjacent charger grid electrodes that is below that electric field strength which would result in spark-over between said adjacent charger grid electrodes;

non-aerosol gaseous fluid mover means for moving the non-aerosol gaseous fluid through said first housing between said first end and said second end thereof; wherein said charger grid creates a substantially uniform corona across a cross-section of said first housing and imparts a charge onto the non-aerosol gaseous fluid as the non-aerosol gaseous fluid moves from said first end of said first housing to said second end of said first housing;

a second housing having a first end and a second end, said second end of said first housing interconnecting with said second housing of each charger of said at least one charger between said first end and said second end of said second housing;

port means at said first end of said second housing for admitting a moving second fluid;

at least one first inlet means on said second housing adjacent said port means for admitting at least one auxiliary fluid into said second housing for mixing with said second fluid to form a moving mixed fluid, said moving non-aerosol gaseous fluid from said first housing of each said charger mixing with said moving mixed fluid in said second housing to form an electrically charged moving third fluid.

6. The apparatus of claim 5, wherein said electric field strength is at least substantially near, but not including, that electric field strength which would result in spark-over between said adjacent charger grid electrodes.

7. The apparatus of claim 6, wherein said at least one charger comprises at least two chargers.

8. The apparatus of claim 5, further comprising at least one second inlet means on said second housing adjacent said second end of said second housing for admitting at least one second auxiliary fluid to mix with said electrically charged third moving fluid.

9. The apparatus of claim 8, wherein said electric field strength is at least substantially near, but not including, that electric field strength which would result in spark-over between said adjacent charger grid electrodes.

10. A method for electrostatically treating a primary fluid with respect to at least one of bacteria and viruses, comprising the steps of:

providing a plurality of electrodes, adjacent electrodes of said plurality of electrodes being uniformly mutually separated a predetermined distance;

selectively electrifying said plurality of electrodes so as to produce a substantially uniform electric field therebetween;

moving a gaseous fluid past said plurality of electrodes, said electric field creating a substantially uniform corona in the gaseous fluid so as to provide an electrically charged gaseous fluid; and mixing said electrically charged gaseous fluid with the primary fluid so as to provide electrical charge to the primary fluid so as to effect at least one of antibacteriological and antiviral action thereto.

11. The method of claim 10, wherein said step of selectively electrifying comprises producing a substantially uniform electric field between said plurality of electrodes that is just less than that electric field which would result in spark-over between said adjacent electrodes.

12. The method of claim 11, further comprising repeating said step of mixing a selected number of times in order to further treat said primary fluid.

13. The method of claim 11, wherein the primary fluid comprises blood.

14. The method of claim 11, wherein the primary fluid comprises water.

15. A method for providing electrostatic treatment of a substance with respect to at least one of bacteria and viruses, comprising the steps of:

providing a plurality of electrodes, adjacent electrodes of said plurality of electrodes being uniformly mutually separated a predetermined distance;

selectively electrifying said plurality of electrodes so as to produce a substantially uniform electric field therebetween;

moving a gaseous fluid past said plurality of electrodes, said electric field creating a substantially uniform corona in the gaseous fluid so as to provide an electrically charged gaseous fluid; and passing said said electrically charged gaseous fluid over the substance to provide electrical charge to the substance so as to effect at least one of antibacteriological and antiviral action thereto.

16. The method of claim 15, wherein said step of selectively electrifying comprises producing a substantially uniform electric field between said plurality of electrodes that is just less than that electric field which would result in spark-over between said adjacent electrodes.

17. The method of claim 16, further comprising repeating said step of passing a selected number of times in order to further treat the substance.

18. The method of claim 16, wherein the substance comprises a biological substance.

19. The method of claim 18, wherein the substance comprises an article of foodstuff.

20. The method of claim 18, wherein the substance comprises tissue of an organism.

21. A method for providing an electrically charged liquid fluid, comprising the steps of:

providing a plurality of electrodes, adjacent electrodes of said plurality of electrodes being uniformly mutually separated a predetermined distance;

selectively electrifying said plurality of electrodes so as to produce a substantially uniform electric field therebetween;

moving a gaseous fluid past said plurality of electrodes, said electric field creating a substantially uniform corona in the gaseous fluid so as to provide an electrically charged gaseous fluid;

mixing said electrically charged gaseous fluid with a liquid fluid so as to provide the electrically charged liquid fluid; and repeating said step of mixing at least once so as to re-mix the electrically charged liquid fluid with said electrically charged gaseous fluid.

22. The method of claim 21, wherein said step of selectively electrifying comprises producing a substantially uniform electric field between said plurality of electrodes that is just less than that electric field which would result in spark-over between said adjacent electrodes.

23. A method for providing an electrically charged fluid, comprising the steps of:

providing a plurality of electrodes, adjacent electrodes of said plurality of electrodes being uniformly mutually separated a predetermined distance;

selectively electrifying said plurality of electrodes so as to produce a substantially uniform electric field therebetween;

moving a gaseous non-aerosol fluid past said plurality of electrodes, said electric field creating a substantially uniform corona in the gaseous non-aerosol fluid so as to provide an electrically charged non-aerosol fluid;

mixing said electrically charged non-aerosol gaseous fluid with a second fluid so as to provide the electrically charged fluid; and repeating said step of mixing at least once so as to re-mix the electrically charged fluid with said electrically charged non-aerosol gaseous fluid.

24. The method of claim 23, wherein said step of selectively electrifying comprises producing a substantially uniform electric field between said plurality of electrodes that is just less than that electric field which would result in spark-over between said adjacent electrodes.

25. A method for charging a receptor, comprising the steps of:

providing a plurality of electrodes, adjacent electrodes of said plurality of electrodes being uniformly mutually separated a predetermined distance;

selectively electrifying said plurality of electrodes so as to produce a substantially uniform electric field therebetween;

moving a gaseous fluid past said plurality of electrodes, said electric field creating a substantially uniform corona in the gaseous fluid so as to provide an electrically charged gaseous fluid;

passing said electrically charged gaseous fluid over the receptor to provide electrical charge to the receptor; and repeating said step of passing at least one additional time in order to further charge the receptor.

26. The method of claim 25, wherein said step of selectively electrifying comprises producing a substantially uniform electric field between said plurality of electrodes that is just less than that electric field which would result in spark-over between said adjacent electrodes.

27. A method for providing an electrically charged combustible fluid, comprising the steps of:

providing a plurality of electrodes, adjacent electrodes of said plurality of electrodes being uniformly mutually separated a predetermined distance;

selectively electrifying said plurality of electrodes so as to produce a substantially uniform electric field therebetween;

moving a gaseous non-aerosol fluid past said plurality of electrodes, said electric field creating a substantially uniform corona in the gaseous non-aerosol fluid so as to provide an electrically charged non-aerosol fluid; and mixing said electrically charged non-aerosol gaseous fluid with a combustible fluid so as to provide the electrically charged combustible fluid.

28. The method of claim 27, wherein said step of selectively electrifying comprises producing a substantially uniform electric field between said plurality of electrodes that is just less than that electric field which would result in spark-over between said adjacent electrodes.

29. The method of claim 28, further comprising repeating said step of mixing at least once so as to re-mix the electrically charged combustible fluid with said electrically charged non-aerosol gaseous fluid.

30. A method for providing an electrically charged biological fluid, comprising the steps of:

providing a plurality of electrodes, adjacent electrodes of said plurality of electrodes being uniformly mutually separated a predetermined distance;

selectively electrifying said plurality of electrodes so as to produce a substantially uniform electric field therebetween;

moving a gaseous non-aerosol fluid past said plurality of electrodes, said electric field creating a substantially uniform corona in the gaseous non-aerosol fluid so as to provide an electrically charged non-aerosol fluid; and mixing said electrically charged non-aerosol gaseous fluid with a biological fluid so as to provide the electrically charged biological fluid.

31. The method of claim 30, wherein said step of selectively electrifying comprises producing a substantially uniform electric field between said plurality of electrodes that is just less than that electric field which would result in spark-over between said adjacent electrodes.

32. The method of claim 31, further comprising repeating said step of mixing at least once so as to re-mix the electrically charged biological fluid with said electrically charged non-aerosol gaseous fluid.

33. A method for providing an electrically charged molten polymer fluid, comprising the steps of:

providing a plurality of electrodes, adjacent electrodes of said plurality of electrodes being uniformly mutually separated a predetermined distance;

selectively electrifying said plurality of electrodes so as to produce a substantially uniform electric field therebetween;

moving a gaseous non-aerosol fluid past said plurality of electrodes, said electric field creating a substantially uniform corona in the gaseous non-aerosol fluid so as to provide an electrically charged non-aerosol fluid; and mixing said electrically charged non-aerosol gaseous fluid with a molten polymer fluid so as to provide the electrically charged molten polymer fluid.

34. The method of claim 33, wherein said step of selectively electrifying comprises producing a substantially uniform electric field between said plurality of electrodes that is just less than that electric field which would result in spark-over between said adjacent electrodes.

35. The method of claim 34, further comprising repeating said step of mixing at least once so as to re-mix the electrically charged molten polymer fluid with said electrically charged non-aerosol gaseous fluid.

* * * * *